US007576281B2

(12) United States Patent
Lui et al.

(10) Patent No.: US 7,576,281 B2
(45) Date of Patent: Aug. 18, 2009

(54) APPARATUS FOR ALTERING THE COURSE OF TRAVELLING OF A MOVING ARTICLE AND A METHOD THEREOF

(75) Inventors: Pao Chuen Lui, Singapore (SG); Saik Hay Fong, Singapore (SG); Hong Soon Tan, Singapore (SG); Tee Peng Toh, Singapore (SG)

(73) Assignee: Singapore Technologies Dynamics Pte Ltd, Singapore (SG)

( * ) Notice: Subject to any disclaimer, the term of this patent is extended or adjusted under 35 U.S.C. 154(b) by 0 days.

(21) Appl. No.: 11/763,893

(22) Filed: Jun. 15, 2007

(65) Prior Publication Data

US 2008/0202403 A1 Aug. 28, 2008

Related U.S. Application Data

(63) Continuation of application No. PCT/SG2005/000412, filed on Dec. 2, 2005.

(30) Foreign Application Priority Data

Dec. 17, 2004 (SG) ..... 200407511-5

(51) Int. Cl.
*F42B 19/00* (2006.01)

(52) U.S. Cl. ..... 114/20.1; 114/20.3; 114/21.3; 114/22; 114/23

(58) Field of Classification Search ..... 114/20.1, 114/20.3, 22

See application file for complete search history.

(56) References Cited

U.S. PATENT DOCUMENTS 4,231,311 A * 11/1980 Longerich ..... 114/244

(Continued)

FOREIGN PATENT DOCUMENTS

| | | |
|---|---|---|
| GB | 1131685 | 10/1968 |
| RU | 2 219 092 C2 | 12/2003 |

OTHER PUBLICATIONS

International Search Report dated Feb. 16, 2006 from the Austrian Patent Office for PCT/SG2005/000412 filed Dec. 2, 2005 for Singapore Technologies Dynamics Pte Ltd.

(Continued)

*Primary Examiner*—Michael Carone
*Assistant Examiner*—Daniel J Troy
(74) *Attorney, Agent, or Firm*—Ohlandt, Greeley, Ruggiero & Perle, L.L.P.

(57) ABSTRACT

The present invention relates to an apparatus for altering the course of a moving article and a method thereof comprising of a launching aircraft or surface craft to deploy said apparatus towards a moving article. The apparatus comprises of a driving mechanism (10), wherein said driving mechanism (10) further comprises of a plurality of sections such as a nose section (12), a propulsion section (14), a drag chute section (16) and a cutting section (18), and wherein said sections are integrally connected with one another in a tight and secure manner. The driving mechanism (10) is capable to be launched from an aircraft or a surface craft towards a target and wherein upon launch said driving mechanism (10) is capable of steering itself on its own towards its target and thereafter attaching itself to the target and wherein by using the drag chute section (16). The driving mechanism (10) is designed and configured to alter the initial trajectory or direction of the target to another direction by dragging it and wherein permanently changing the course of the said target.

24 Claims, 7 Drawing Sheets

U.S. PATENT DOCUMENTS

| | | | | |
|---|---|---|---|---|
| 5,583,311 | A * | 12/1996 | Rieger | 89/1.11 |
| 5,947,051 | A * | 9/1999 | Geiger | 114/313 |
| 6,325,015 | B1 * | 12/2001 | Garcia et al. | 114/382 |
| 7,193,174 | B2 * | 3/2007 | Brandt et al. | 219/121.49 |

OTHER PUBLICATIONS

Written Opinion of the International Searching Authority dated Feb. 16, 2006 from the Austrian Patent Office for PCT/SG2005/000412 filed Dec. 2, 2005 for Singapore Technologies Dynamics Pte Ltd.

* cited by examiner

APPARATUS FOR ALTERING THE COURSE OF TRAVELLING OF A MOVING ARTICLE AND A METHOD THEREOF

CROSS-REFERENCE TO RELATED APPLICATIONS

The present application is a continuation of International Application No. PCT/SG2005/000412, filed Dec. 2, 2005.

FIELD OF THE INVENTION

The present invention relates to an apparatus for altering the course of travelling of a moving article and a method thereof. More particularly, the present invention relates to an apparatus, which is capable of intercepting an errant moving article and thereafter altering its path of movement to a desired direction. Most particularly, the present invention relates to an apparatus for intercepting and altering the direction of an article moving in water such as vessels, submarines and the like and a method thereof.

BACKGROUND OF THE INVENTION

It was not common in the past to use travelling modes as a weapon to attack or destroy targets. However, history was altered when invaders used such travelling modes as weapons. Such examples could be seen during the World War II and more recently during the Sep. 11, 2001 attack, whereby four U.S. planes hijacked by terrorists, crashed into the World Trade Center, the Pentagon and a field in Pennsylvania. Since then, it has become a major threat that aircrafts are used as weapons by terrorists or hijackers. Various security measures have been taken to reduce the risk of using aircrafts as weapons. However, it is also possible that similar situation could occur if ships or vessels or submarines are used as weapons for targeting and destroying other ships, vessels or submarines at sea, ports, navy bases or coastal townships. The situation could worsen because most vessels or ships or submarines nowadays are loaded with a huge amount of flammable material such as fuel, chemicals, nuclear reactors and the like. The damage done by such method of using ships, vessels or submarines as weapons for targeting and destroying desired targets would undoubtedly be catastrophic and unavoidable if no steps are taken.

Therefore, if such vessels, ships, submarines and the like articles are used as weapons to destroy desired targets, then it is necessary to either stop or alter direction of such said intruding vessels, ships, submarines or the like article to avoid the planned destruction. Any methods of stopping or altering the direction of such intrusion must be executed carefully and swiftly. There are a number of prior art documents which describes such execution but yet are not relevant to the present invention. The purpose of describing said prior art documents in this application is merely for the purpose of research and discussion.

U.S. Pat. No. 6,418,870 (hereinafter referred as '870) teaches a vehicle launch assembly to launch a torpedo with a plurality of gas generators held therein. Further to this, the said '870 discloses that the said gas generators are automotive air bag inflators, which are probably used to propel the said torpedo at a desired direction.

U.S. Pat. No. 5,444,669 (hereinafter referred as '669) teaches a torpedo relative position measuring system. The said '669 further discloses that the invention includes an active sonar system and a passive magnetic system, both coupled to computing apparatus which operates in response to a set of stored computer programs, all located in the torpedo for homing in on a ferrous target. At long ranges and mid ranges, the torpedo is directed to the target by the sonar system, while at near ranges the magnetic system determines the x, y, z, relative position coordinates between the target and the torpedo in accordance with a calibrated stored magnetic model of the target and numerical solution of the non-linear equations linking the targets magnetic field, as measured at the torpedo, with the targets relative position. Guidance Information derived there from is then fed to the torpedo's guidance system. With the magnetic system providing the relative position of the target at close range, the torpedo's normal guidance system can readily steer the torpedo to a desired hit point on the target.

U.S. Pat. No. 5,247,895 (hereinafter referred as '895) teaches method and apparatus for guiding an acoustic torpedo toward a ship selected as target which, as a defense against torpedoes drags noise generating decoys (so-called disturbance generators) wherein the torpedo is acoustically guided toward the noise source having the greatest noise level for the torpedo. This patent further discloses that as the torpedo approaches the noise source a check is made to detect the presence of a wake, and after detection of a wake in the immediate vicinity of the noise source during passage of the torpedo underneath the noise source, a check is made for the minimum expanse of the noise source in the vertical and travelling direction of the torpedo. The torpedo is set to search for a further noise source if no wake is detected or if a wake is detected in the vicinity of the noise source but a predetermined minimum expanse for the noise source is not detected. In short, this patent teaches a means of creating a disturbance to a launched torpedo and forcing the said torpedo to follow and target the source of the disturbances rather than any earlier targeted ship.

U.S. Pat. No. 6,714,845 (hereinafter referred as '845) teaches a method and apparatus for directing a pursuing vehicle, such as a torpedo, on an intercept trajectory from a launching vehicle to a target vehicle with evasion capabilities. This patent further discloses that the target vehicle is alerted to pursuing vehicle at the time that the pursuing vehicle enables its seeker. Models of the pursuing vehicle and evading target provide proposed trajectories based upon various environmental considerations. A guidance system uses estimates of initial operating parameter solutions for the pursuing vehicle, such as gyro angle, intercept time and run-to-enable time, to begin a convergent, iterative process that defines final operating parameter solutions from which the guidance parameters are determined and transferred to the pursuing vehicle at launch.

U.S. Pat. No. 4,429,652 (hereinafter referred as '652) teaches a means for enhancing the maneuverability, speed, survivability, and targeting accuracy of a torpedo moving below the surface of a body of water. According to this patent, ultrasonic vibrations are set-up at the exterior of the torpedo hull, using controlled piezoelectric crystals to generate the vibrations in the 5-50 KHZ and 5-30 KW frequency and power ranges. This patent further discloses ways for operating the piezoelectric crystals to steer the hull without need for mechanically moving parts such as flaps or fins.

U.S. Pat. No. 6,591,774 and 2003/0051652 (hereinafter referred as '774 and '1652) teaches an apparatus and methods for protecting ships and harbours from attack from other vessels. A barrier, fence or obstruction is constructed around the ship or harbour to be defended, either floating on the surface above and/or beneath the surface of the water. When a boat attempts to force its way through the barrier, the barrier uses the momentum of the vessel against itself by using the forward momentum of the attacking vessel in such a manner as to divert, impede, stop, damage or destroy the vessel or mitigate a blast from a vessel. The barrier may be active or passive. Also, a constructed wall of water can be provided to stop, destroy or disable a vessel attempting to go through the wall. In other words, both patents disclose a method of stopping, destroying or disabling an invading ship, particularly small sized ship from the target. Nevertheless, both inventions surely appear to have numerous flaws.

U.S. Pat. No. 4,418,624 (hereinafter referred as '624) teaches an aerodynamic braking arrangement for projectile components which are to be salvaged, such as detonators. This patent also discloses that the invention further consist of a drag parachute having a high air-resistance index and of cables which connect the projectile components with the parachute. The drag chute is formed as a brake basket which consists of two cup-shaped tops at the ends thereof constituted of metal or plastic material, which are separated from each other along the axial direction of the projectile through the intermediary of at least one space formed of metal or plastic material, wherein the cables are fastened to one of the tops.

All the above-mentioned prior art consist on some disadvantages as they are all designed to stop or destroy any launched weapon and not the source of launch. Some of the prior art inventions as described above use quite primitive approach to avoid an attack, which in return could be a disaster Any discussion of documents, devices, acts or knowledge in this specification is included to explain the context of the invention. It should not be taken as an admission that any of the material forms a part of the prior art base or the common general knowledge in the relevant art in Singapore or elsewhere on or before the priority date of the disclosure and claims herein. All statements as to the date or representation as to the contents of these documents is based on the information available to the applicant and does not constitute any admission as to the correctness of the dates or contents of these documents.

Therefore, in light of the above-mentioned disadvantages, it is an object of the present invention to introduce an apparatus and method to alter the direction on an article which maybe travelling fast and with large momentum to avoid any collision or planned destruction. It is yet another object of the present invention to provide an external steering means to alter the original trajectory of an article to a desired direction.

SUMMARY OF THE INVENTION

The present invention relates to an apparatus for altering the course of a moving article comprising of a launching aircraft or surface craft to deploy said apparatus towards a moving article. Said apparatus further comprises of a driving mechanism, wherein said driving mechanism further comprises of a plurality of sections such as a nose section, a propulsion section, a drag chute section and a cutting section. Said sections are integrally connected with one another in a tight and secure manner. According to the present invention said driving mechanism is capable to be launched from an aircraft or a surface craft towards a target and wherein upon launch said driving mechanism is capable of steering itself on its own towards its target and thereafter attaching itself to the target. By using the drag chute section, said driving mechanism is designed and configured to alter the initial trajectory or direction of the target to another direction by dragging it and wherein permanently changing the course of the said target.

The driving mechanism as mentioned above is further configured and designed to include at least one surface in which is generally flat compared to the rest of the surface. The driving mechanism could be selected from a tubular shaped like, rectangular shaped like or any other geometrical shaped like structure.

According to the preferred embodiment the nose portion includes a navigation unit and a homing unit. The propulsion section includes a propeller assembly, which can either utilize liquid based propellent as fuel or electrical power supply as fuel or turbine drive means as fuel or the like propellent means known in the art. According to the present invention the drag chute section includes at least one chute assembly. Said chute assembly further comprises of a main chute and a secondary chute. The main chute has a greater dimension than the secondary chute, and wherein the secondary chute is configured to deploy first before the main chute is deployed.

The cutting section of the present embodiment further comprises of a gas cylinder, an electromagnetic coil, a motor and a plurality of cutting rods. The gas cylinder is nitrogen gas cylinder and wherein said gas cylinder is provided therein to supply fuel for the cutting rods to operate.

The electromagnetic coil is a conventional electromagnetic coil wherein said electromagnetic coil is powered by a power supply means and wherein said electromagnetic coil is designed and configured to produce a magnetic force to temporarily mount the driving mechanism to the target during operation.

The motor as mentioned earlier is provided to drive a rack and pinion mechanism which in return activates the cutting rods and are extended outwardly from the inner surface of the driving mechanism towards the target. The cutting rods are selected from plasma cutting rods. Each cutting rod is positioned diagonally at an angle in relation with the other cutting rod and is extended outwardly in the same manner.

The driving mechanism as mentioned in the description could be selected from a torpedo, small ships and the like structures. Similarly, the target is an errant ship and may be selected from a vessel, submarine and the like surface craft.

A method of altering the course of travelling of a moving article as described in the present invention wherein when a target is identified, the driving mechanism is deployed and is driven by its propulsion section towards the target. Upon approaching the target, said driving mechanism with the assistant of the nose section would approach the target preferably from the rear and would home itself into the stem of the target.

When the driving mechanism is in position, an electromagnetic coil in the cutting section would be activated and thereafter creating a magnetic field to temporarily mount the driving mechanism onto the stern of the target. After said driving mechanism is electromagnetically mounted onto the target said driving mechanism would be travelling parallel and at the same speed of the target and using the said target as a propeller means.

Further according to the invention, once the said driving mechanism is temporarily mounted to the target, the cutting section would be activated and wherein at least one opening would be created at the bottom of the target. After the opening is created, a motor means held in the cutting section would be activated and would result in a plurality of diagonally positioned cutting rods to be extended by means of rack and pinion mechanism outwardly from the driving mechanism and into the opening and thereafter anchoring itself diagonally into the crust of the target.

When the driving mechanism is securely mounted to the target, the propulsion section would be ejected from the driving mechanism and thereafter exposing the drag chute section. A secondary chute is deployed followed by a main chute and wherein when restriction is created within the chutes; a drag is created resulting in the target to alter its initial trajectory by the chutes to another path.

According to the present invention at least one driving mechanism could be deployed during operation and wherein the driving mechanism is preferably mounted onto the side of the target.

Other aspects and preferred aspects are disclosed in the specification and/or defined in the appended claims, forming a part of the description of the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Further disclosure, objects, advantages and aspects of the present application may be better understood by those skilled in the relevant art by reference to the following description of preferred embodiments taken in conjunction with the accompanying drawings, which are given by way of illustration only, and thus are not limitative of the present invention, and in which.

DETAILED DESCRIPTION OF THE PRESENT INVENTION

The present invention will now be described in detail with reference made to the accompanied figures but not limited to the same thereof.

Figure 1:
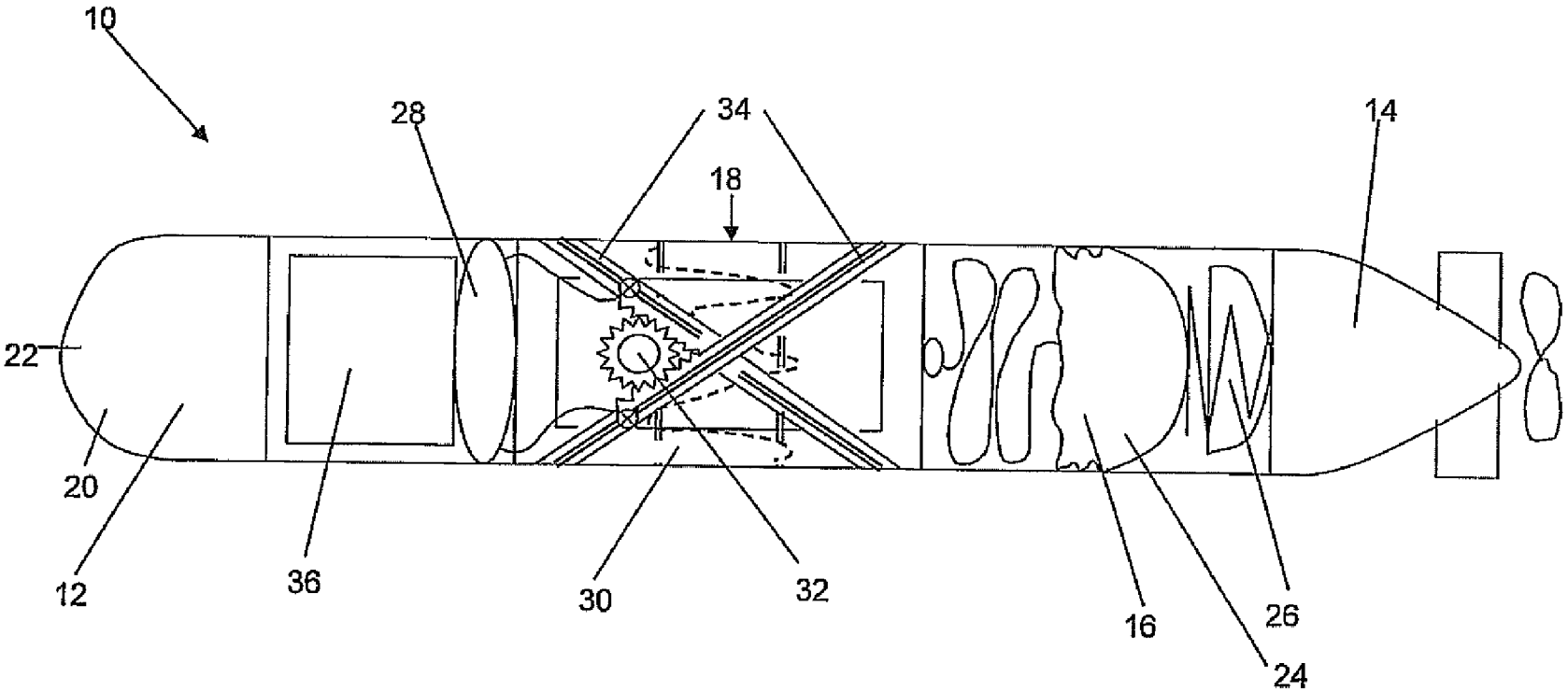
FIG. 1 shows an overall layout of the complete system within the driving mechanism.

Reference is first made to FIG. 1 wherein there is shown an apparatus for altering the course of travelling of a moving article hereinafter referred as a driving mechanism (10). In the preferred embodiment as shown in FIG. 1 said driving mechanism (10) is substantially a tubular shaped like member with at least one tapered end while the other end is rounded. It should be understood that other type of combinations should not be isolated herein as the configuration of the said driving mechanism (10) may vary according to purpose and definition.

Generally, said driving mechanism (10) comprises of at least four main sections, namely a nose section (12), propulsion section (14), a drag chute section (16) and a cutting section (18). The rounded end as described earlier is actually the nose section (12). According to the present invention the nose section (12) further includes a navigation unit (20) and a homing unit (22). Both the navigation unit (20) and the homing unit (22) are conventional devices. The said navigation unit (20) and homing unit (22) utilize a conventionally available navigation and homing control mechanisms such as those used in modern torpedos in order to guide and steer the torpedo towards its target. Further to this, the algorithm used to control said torpedo could be easily modified in order to instruct any launched torpedo to approach its target from the rear and to home accurately to the approximate of the target such as a stern of a ship. As said navigation unit (20) and homing unit (22) are conventional units, therefore said units would not be described further in detail.

The propulsion section (14) as shown in FIG. 1 is located at the tapered end of the driving mechanism as mentioned earlier. The propulsion section (14) of the present invention is similar in construction and configuration as in a modern torpedo. In the present embodiment the propulsion section (14) is designed and configured to use a liquid based propellant such as nitrate ester solution to power the propellers. Further to this, a plurality of fins is provided therein to act as a means to control and steer the driving mechanism (10) to any desired direction just as in a modern torpedo.

The drag chute section (16) is designed and configured to house at least one main chute (24) and at least one secondary chute (26). Said chutes are conventional chutes and therefore it would not be described in more detail.

The cutting section (18) of the present invention comprises of a cutting gas cylinder (28), an electromagnetic coil (30), and a motor with a rack and pinion mechanism (32) and a plurality of plasma cutting rods (34). Further to this, the present invention is also provided with a power supply means (36), which hereinafter is a battery. It would be appreciated that the external surface of the driving mechanism (10) where the cutting section (18) is located would be substantially flat in comparison to the other sections of the driving mechanism (10). The purpose of such configuration would be described later in the description.

Now the manner the above mentioned sections are connected to one another and other features not described earlier (if any) would be described. Reference is again made to FIG. 1 wherein the arrangement of the sections would be described beginning from the nose section (12) of the driving mechanism (10) and towards the propulsion section (14) of the same. The arrangement of the present invention is just an example and the most suitable, however, other type of arrangements may also be adopted even though it may cause some difficulties during operation. The nose section (12) is attached to the cutting section (18) via an attachment portion. Said attachment portion houses the battery (36) and the cutting gas cylinder (28) as mentioned earlier. The cutting section (18) is further connected to the drag chute section (18). Finally the drag chute section (16) is connected to the propulsion section (14). All the above sections are securely house in the driving mechanism (10) and are connected with one another either electrically or mechanically or both and maybe controlled by a central processing unit housed within the driving mechanism (10) or in a remote location or a combination of both. It should be appreciated that the entire driving mechanism (10) is airtight and watertight similar to the configuration of the modern torpedo.

Figure 2:
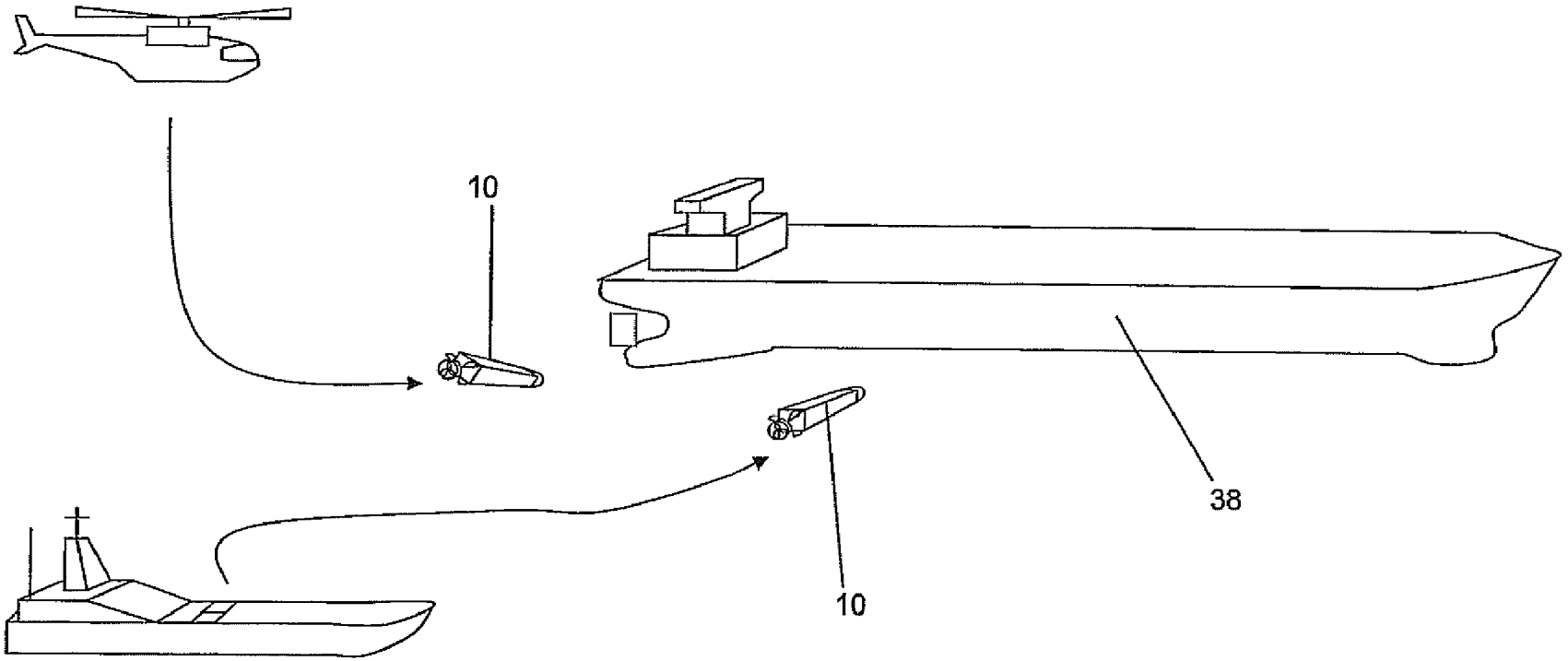
FIG. 2 illustrates how the driving mechanism can be launched from the air or sea.
Figure 3:
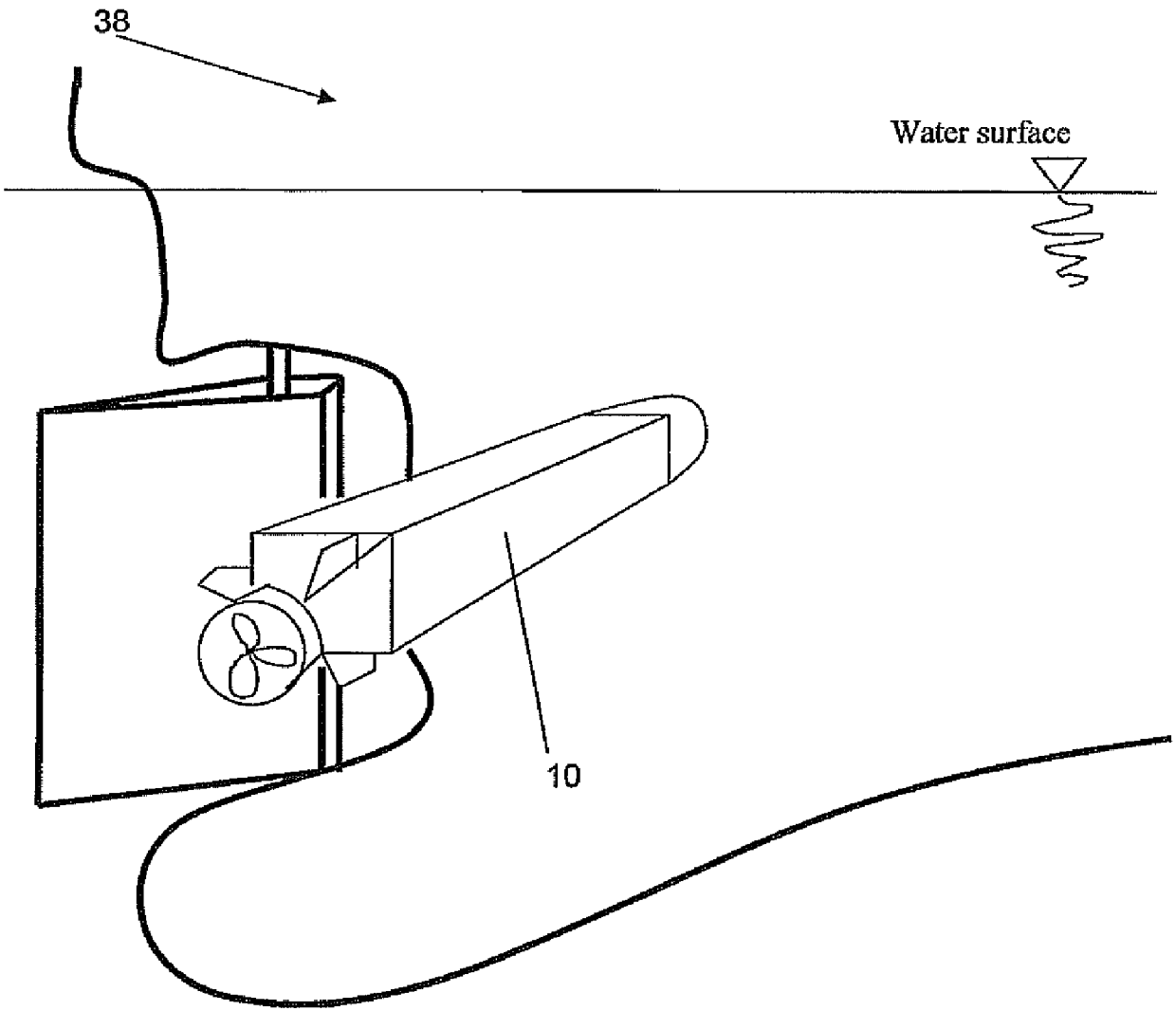
FIG. 3 shows a driving mechanism approaches from the stern of a targeted ship.
Figure 4:
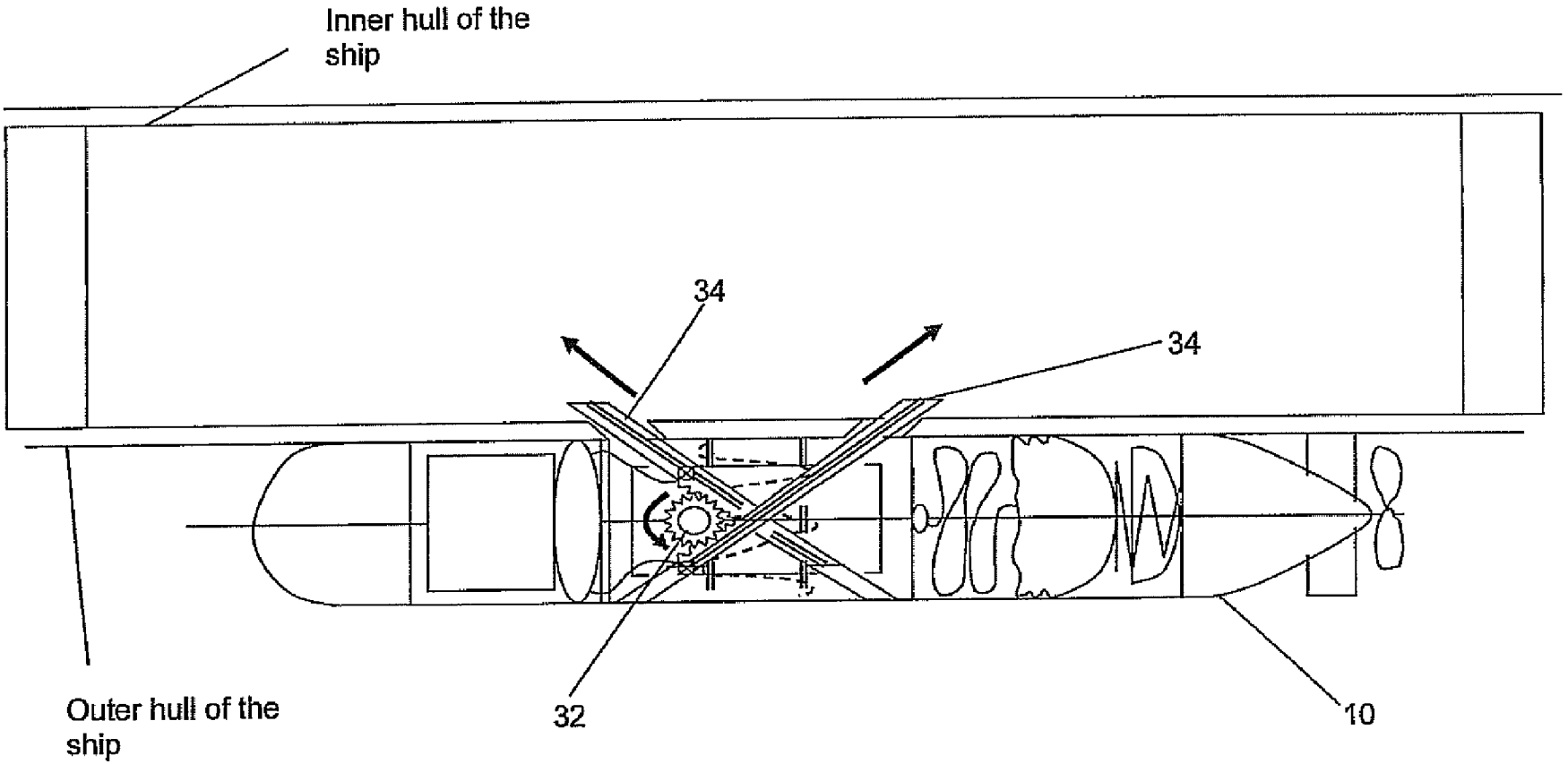
FIG. 4 shows a close up view of a plasma gas cutter in operation.
Figure 5:
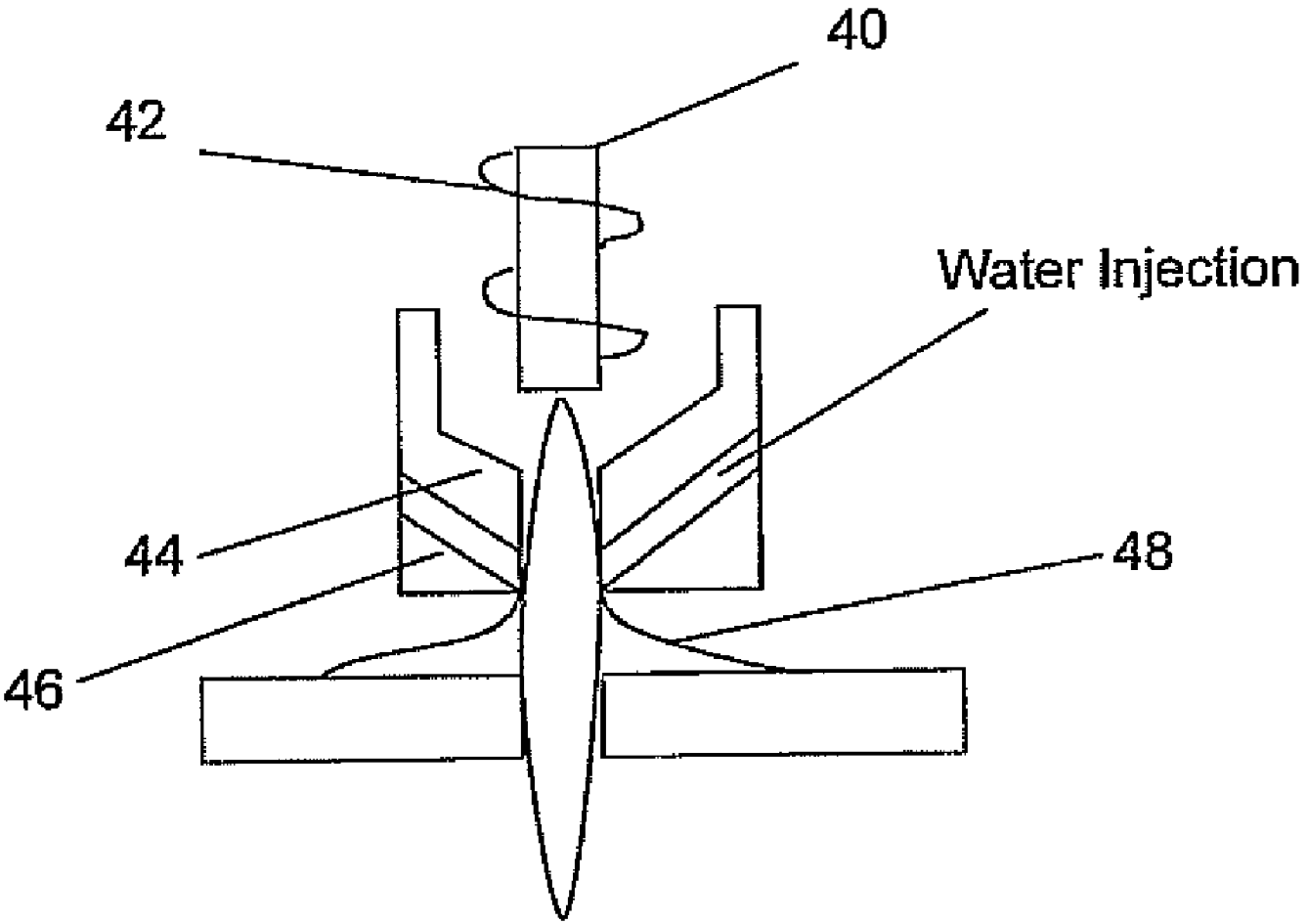
FIG. 5 illustrates how the plasma cutting rods operates according to the present invention.
Figure 6:
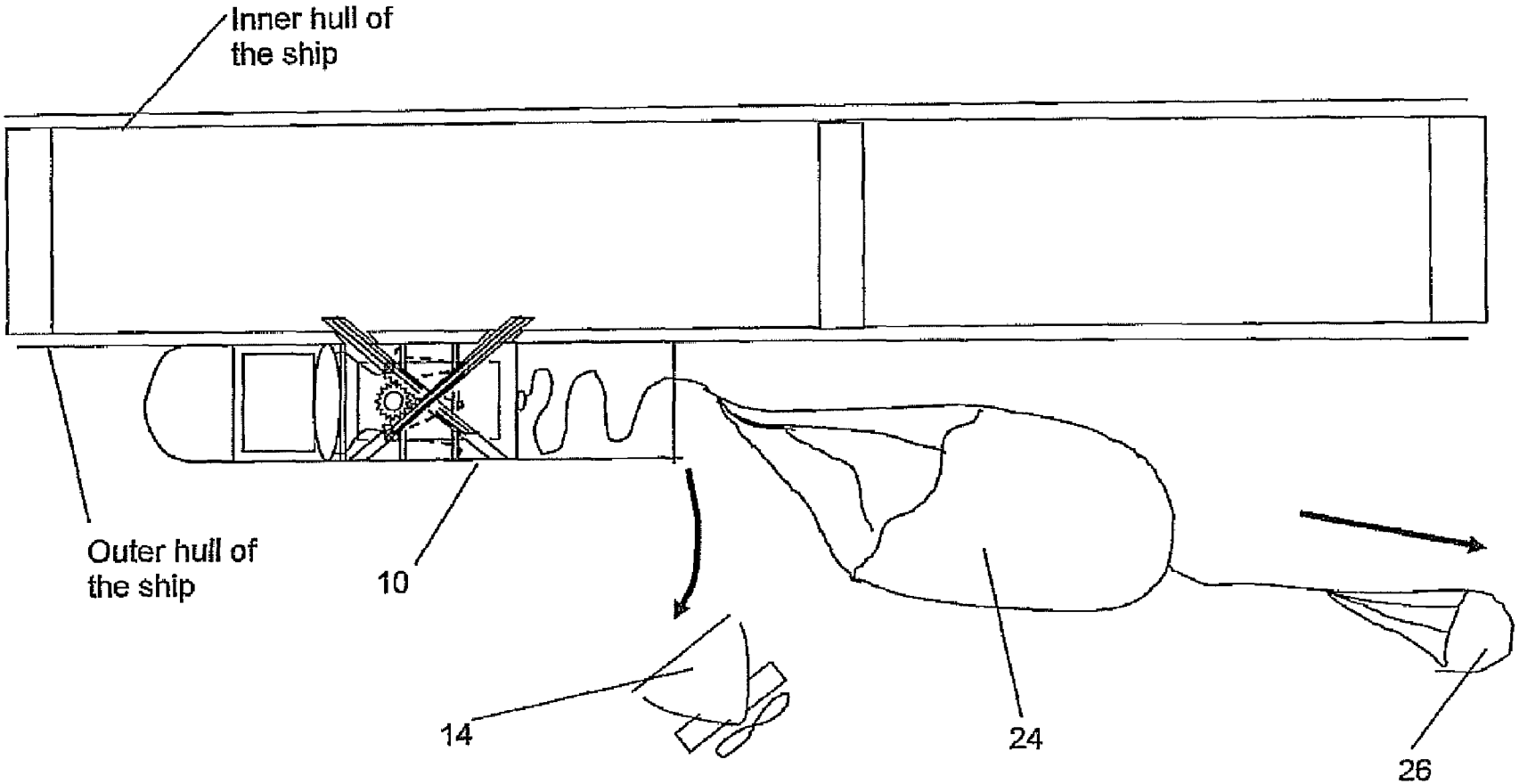
FIG. 6 illustrates the jettison of the propulsion unit and deployment of the pilot chute and drag chute in the water.
Figures 6, 7:
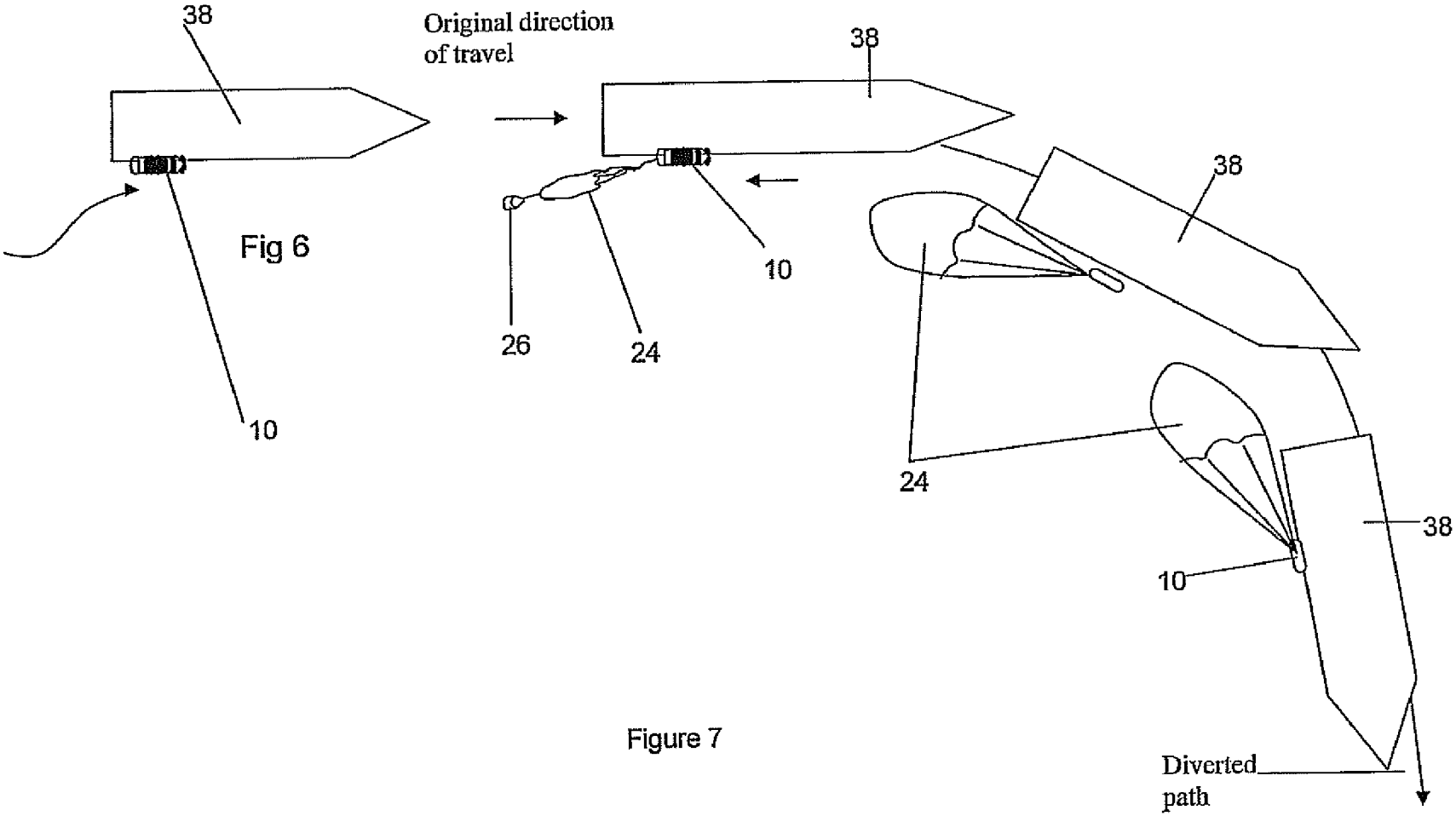
FIG. 7 illustrate how a driving mechanism can divert a ship from its original direction of travel.

Now the working mechanism of the present invention and other features not described earlier would be described. In order to facilitate the explanation of the present invention, the driving mechanism (10) would be configured and designed to be similar in shape and design of a modern torpedo. The present invention could be launched from an aircraft or a surface craft. In this description, the target would be a ship hereinafter referred as an errant ship (38) as shown in FIG. 2.

The detail description below will make reference to the remaining figures either independently or in a combination of any thereof. Therefore, it may not be necessary to mention hereinafter which figures are being referred to.

Reference is now made to FIGS. 2 to 7 which show the preferred embodiment in a shape of a torpedo being deployed either from an aircraft or a surface craft to a target hereinafter referred as an errant ship (38). Only for this particular purpose of describing the invention adequately, the driving mechanism (10) would be referred as a torpedo (10). However, it has to be understood that torpedo is only one example of a driving mechanism and should not be confused or limiting its definition.

As mentioned earlier, the torpedo (10) may be deployed from an aircraft or a surface craft. Upon launch said torpedo (10) would be guided by the onboard navigation unit (20) and the homing unit (22) towards the rear end of the errant ship (38). The said torpedo (10) will then travel right under the errant ship (38) and once it is in the vicinity of the hull of the errant ship (38), the electromagnetic coil (30) would be activated. The purpose of the said electromagnetic coil (30) is to generate a sufficient amount of magnetic force allowing the said torpedo (10) to be temporarily secured to the hull of the errant ship (38). As mentioned earlier in this description, a portion of the external surface of the torpedo (10) is a flat surface. This is to ensure that the torpedo (10) would have sufficient surface area to secure itself to the hull of the errant ship (38) during operation.

Once the torpedo (10) is securely held therein, the cutting section (18) would be activated. In other words, the plasma cutting will be activated to create an opening on the hull of the errant ship (38). Plasma cutter uses high current, which is supplied to a plurality of electrodes (40) to ignite the pressurized cutting gas such as nitrogen (42). The nitrogen gas (42) flows through a nozzle (44) towards the hull of the errant ship (38) in a fast and pressurized condition. This constant collision of the fast moving electrons and ions will generate high temperatures ranging more that 15,000° C., which is an ideal temperature for plasma cutting purposes.

In order to prevent any short circuits between the electrode (40) and the metal hull; and in order to prevent any oxidation at the cut portion on the hull of the errant ship (38), a ceramic shield (46) is provided on the nozzle (44). Said ceramic shield (46) is designed and configured to have a cup like shape wherein when attached therein it would encapsulate the said nozzle (44). Short circuit and oxidation is avoided by the said ceramic shield (46) by encapsulating the said nozzle (44) and by creating channel into which a shielding medium (48) such as water can flow thereto. The speed and thickness of the opening created depend on certain criteria such as the type of metal on the hull, the arc current, type of cutting gas used, the flow rate of the gas, the dimension of the nozzle and etc. For example, to create an opening approximately 25 mm in diameter in a 25 mm thick mild steel plate of the hull of the errant ship (38), a 120 A plasma cutter could achieve the required size of opening within 10 to 15 seconds. Other type of gas, which could also be used, is oxygen. However using oxygen as an alternative may cause the life span of the electrodes (40) to shorten and therefore increase the cost of operation.

Once the opening is created, the plasma cutting rods (34) would be extended outwardly from the internal of the torpedo (10) into the hull of the errant ship (38) via the openings created earlier. The plasma cutting rods (34) are driven by the earlier mentioned rack and pinion mechanism. If reference were made to any of the figures, it would be noticeable that the plasma cutting rods (34) are diagonally positioned in the cutting section (18). Therefore, when the said plasma cutting rods (34) are extended into the hull of the errant ship (38), they will form a strong anchoring means to permanently secure the torpedo (10) to the hull of the errant ship (38). It should be understood that when the torpedo (10) is being deployed and is travelling towards the errant ship (38), it is travelling on its own propellers. However, upon securing itself onto the errant ship (38), it would preferably shut down its propellers and travel at the same speed of the errant ship (38) by using the errant ship (38) as a driving mechanism.

Once the said torpedo (10) has itself securely mounted onto the hull of the errant ship (38), the propulsion section (14) of the torpedo (10) would be ejected automatically leaving a portion of the drag chute section (16) exposed therein. Upon the propulsion section (14) being ejected, the secondary chute (26) would be ejected into the water stream by a compressed spring action. When the secondary chute (26) is completely developed, it will trap water within it and this would further result in the main chute (24) being ejected out of the drag chute section (16) into the free stream. It should be understood that the secondary chute (26) acts as a pilot chute before the main chute (24) is ejected. When the main chute (24) is completely developed, it would trap water within it and would generate a drag. According to the present invention, the main chute (24) is preferably greater in size than the secondary chute (26). Once the drag is created, it will inevitably slow down the errant ship (38). In order to steer the errant ship (38) away from its original trajectory, the torpedo (10) is preferably mounted onto the side of the errant ship (38). Taking in consideration the differential in the hydrodynamic drag created by the drag chutes (24,26) and the forward movement of the cruising errant ship (38), the drag will steer the errant ship (38) sideways and divert it from its actual trajectory.

In the present Invention, only one torpedo (10) is utilized therein, however, it would be appreciated that more than one torpedo (10) could be launched to alter the direction of an errant ship (38). The number of torpedos (10) required would depend on the speed the errant ship (38) is travelling, the weight of the said errant ship (38) and etc.

In the present invention, the said driving mechanism (10) is generally a tubular shaped like structure. However, other type of possible configuration such as a rectangular shaped like driving mechanism (10) or other geometrical shapes may also be used therein.

In the present invention the cutting apparatus is driven by a rack and pinion mechanism, however other type of mechanism could also be utilized therein.

In the present invention, in order to temporarily mount the driving mechanism to the hull of the errant ship (38), an electromagnetic coil is utilized to generate a strong magnetic field. However, other means known in the art to temporarily mount the driving mechanism to the hull of the errant ship (38) may be utilized.

In the present invention, even though a plasma cutter is utilized to create an opening in the hull of the errant ship (38), other type of cutting means known in the art may also be utilized therein.

In the present invention, at least one chute is deployed in order to create a drag during operation, however other type of means known in the art to create a drag may also be utilized therein.

In the present invention the driving mechanism (10) is described as a torpedo but yet other type of driving mechanism such as smaller ships and the like may also be utilized. The errant ship (38) as described in the description may not necessarily be a ship as it may also be a submarine, a tanker and the like surface craft known in the art.

In the present invention, the driving mechanism (10) is propelled by utilizing liquid base propellent as fuel, however other type of propellent means known in the art could also be utilized such as an electrically powered propeller or a turbine drive engine using hydrogen peroxide as oxidant.

While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures. For example, although a nail and a screw may not be structural equivalents in that a nail employs a cylindrical surface to secure wooden parts together, whereas a screw employs a helical surface to secure wooden parts together, in the environment of fastening wooden parts, a nail and a screw are equivalent structures.

"Comprises/comprising" when used in this specification is taken to specify the presence of stated features, integers, steps or components but does not preclude the presence or addition of one or more other features, integers, steps, components or groups thereof."

The invention claimed is:

1. An apparatus for altering course of a sailing article, wherein said apparatus is launchable from an aircraft or surface towards said sailing article, wherein said apparatus comprises driving mechanism (10), comprising a nose section (12), a propulsion section (14), a drag chute section (16) and a cutting section (18)

wherein said sections are integrally connected with one another in a tight and secure manner, and wherein upon launch said driving mechanism (10) is capable of steering itself on its own towards the sailing article and thereafter deploy said cutting section (18) to make a cut through said sailing article's hull for attaching itself thereto and wherein said driving mechanism (10) alters the initial trajectory or direction of said sailing article by deploying at least a drag chute (24) from said drag chute section (16).

2. An apparatus as claimed in claim 1 wherein the driving mechanism (10) is further configured and designed to include at least one surface which is generally flat compared to the rest of the surface.

3. An apparatus as claimed in claim 1 wherein the driving mechanism (10) is tubular-shaped or torpedo-shaped.

4. An apparatus as claimed in claim 1 wherein the nose portion (12) includes a navigation unit (20) and a homing unit (22).

5. An apparatus as claimed in claim 1 wherein the propulsion section (14) includes a propeller assembly which is driven by an engine propelled by any one of a selection of electrical power, a petroleum fuel, or liquid base propellant.

6. An apparatus as claimed in claim 1 wherein the drag chute section (16) includes at least one chute assembly.

7. An apparatus as claimed in claim 1 wherein said chute assembly further comprises of a main chute (24) and a secondary chute (26).

8. An apparatus as claimed in claim 7 wherein said main chute (24) has a greater dimension than the secondary chute (26), and wherein the secondary chute (26) is configured to deploy first before the main chute (24) is deployed.

9. An apparatus as claimed in claim 1 wherein the cutting section (18) further comprises of a gas cylinder (28), an electromagnetic coil (30), a motor (32) and a plurality of cutting rods (34).

10. An apparatus as claimed in claim 9 wherein the gas cylinder (28) is nitrogen gas cylinder and wherein said gas cylinder (28) is provided therein to supply fuel for the cutting rods (34) to operate.

11. An apparatus as claimed in claim 9 wherein said electromagnetic coil (30) is a conventional electromagnetic coil (30) wherein said electromagnetic coil (30) is powered by a power supply means (36) and wherein said electromagnetic coil (30) is designed and configured to produce a magnetic force to temporarily mount the driving mechanism (10) to target during operation.

12. An apparatus as claimed in claim 9 wherein the motor (32) is provided to drive a rack and pinion mechanism which activates the cutting rods (34) and are extended outwardly from the inner surface of the driving mechanism towards the target.

13. An apparatus as claimed in claim 12 wherein the cutting rods (34) are selected from plasma cutting rods.

14. An apparatus as claimed in claim 12 wherein the said each cutting rod (34) is positioned diagonally at an angle in relation with the other cutting rod (34) and is extended outwardly in the same manner.

15. A method of altering the course of a sailing article comprising launching the apparatus of claim 1 from an aircraft or a surface craft towards a targeted sailing article;

allowing said apparatus to steer itself towards said targeted sailing article;

attaching said apparatus to said targeted sailing article; and deploying at least a chute to provide drag to change the course of the targeted sailing article.

16. A method as claimed in claim 15 wherein when a target is identified, the driving mechanism (10) is deployed and is driven by its propulsion section (14) towards the target.

17. A method as claimed in claim 15 wherein upon approaching the target, said driving mechanism (10) with the assistant of the nose section (12) approaches the targeted sailing article from the rear and home itself onto the stern of said targeted sailing article.

18. A method as claimed in claim 15 wherein once the diving mechanism (10) is in position, an electromagnetic coil (30) in the cutting section (18) would be activated and thereafter creating a magnetic field to temporarily mount the driving mechanism (10) onto the stem of the target.

19. A method as claimed in claim 15 wherein when the said driving mechanism (10) is electromagnetically mounted on the target, said driving mechanism (10) would be traveling parallel and at the same speed of the target and using the said target as a propeller means.

20. A method as claimed in claim 15 wherein after the opening is created, a motor means (32) held in the cutting section(18) would be activated and would result in a plurality of diagonally positioned cutting rods (34) to be extended by means of rack and pinion mechanism outwardly from the driving mechanism (10) and into the opening and thereafter anchoring itself diagonally into the crust of the target.

21. A method as claimed in claim 15 wherein when the driving mechanism (10) is securely mounted to the target, the propulsion section (14) would be ejected from the driving mechanism (10) and thereafter exposing the drag chute section (16).

22. A method as claimed in claim 15 wherein a secondary chute (26) is deployed followed by a main chute (24) and wherein when restriction is created within the chutes (24,26), a drag is created resulting in the target to alter its initial trajectory by the chutes to another path.

23. A method as claimed in claim 15 wherein at least one driving mechanism (10) could be deployed during operation.

24. A method as claimed in claim 15 wherein the driving mechanism (10) is preferably mounted onto the side of the target.

* * * * *